US008480087B1

(12) United States Patent
Traficant

(10) Patent No.: US 8,480,087 B1
(45) Date of Patent: Jul. 9, 2013

(54) GAMING DEVICE

(76) Inventor: Patrick P. Traficant, Henderson, NV (US)

( * ) Notice: Subject to any disclaimer, the term of this patent is extended or adjusted under 35 U.S.C. 154(b) by 0 days.

(21) Appl. No.: 13/277,894

(22) Filed: Oct. 20, 2011

(51) Int. Cl.
*A63F 3/06* (2006.01)

(52) U.S. Cl.
USPC ..... 273/144 B; 273/144 R; 463/22

(58) Field of Classification Search
USPC ..... 273/144 B, 144 A, 144 R, 138.2; 463/22
See application file for complete search history.

(56) References Cited

U.S. PATENT DOCUMENTS 1,928,572 A * 9/1933 Pool ..... 273/144 B
2,315,323 A * 3/1943 Fostos ..... 273/144 A
4,508,346 A * 4/1985 Salvucci ..... 273/144 B
5,088,737 A * 2/1992 Frank et al. ..... 463/18
6,168,155 B1 * 1/2001 Kuhlman et al. ..... 273/144 A
6,688,597 B2 * 2/2004 Jones ..... 273/274
8,235,388 B1 * 8/2012 Itkis et al. ..... 273/144 A
2004/0140617 A1 * 7/2004 Cordell ..... 273/292

* cited by examiner

*Primary Examiner* — Benjamin Layno

(57) ABSTRACT

A gaming device configured to randomly generate at least one pair of numbered balls in a craps game as a substitute for rolling dice, the gaming device including a blower assembly disposed in a housing that, upon selective activation of an on-off switch or a signal transmitter, circulates air through an airflow tube into a casing cavity to push a pair of the numbered balls contained within a cavity of a transparent casing disposed atop the housing into an upper chamber of a ball receiving tube centrally disposed in the casing.

5 Claims, 4 Drawing Sheets

GAMING DEVICE

BACKGROUND OF THE INVENTION

Various types of gaming devices are known in the prior art. However, what is needed is a gaming device configured to randomly generate at least one pair of numbered balls in a craps game as a substitute for rolling a pair of dice, the device including a housing containing a blower assembly which includes a motor, a fan, and a filter for the fan as well as a signal receiver; a transparent casing which includes an outer wall, a lid, and a cavity therebetween; a ball receiving tube, having an upper chamber removably secured to a lower chamber thereof, centrally disposed in the lid; an on-off switch and a signal transmitter in operational communication with the motor, each of which when activated activate the motor and, in turn, the fan, which circulates air through an airflow tube and into the cavity thereby randomly pushing a pair of numbered balls contained within the cavity into the ball receiving tube upper chamber.

FIELD OF THE INVENTION

The present invention relates to gaming device, and more particularly, to a gaming device for randomly generating at least one pair of numbered balls in a craps game as a substitute for rolling a pair of dice by utilizing a blower assembly in a housing that circulates air, upon selective activation of an on-off switch or a signal transmitter, through an airflow tube into a cavity to push a pair of the numbered balls contained within a cavity of a transparent casing into an upper chamber of a ball receiving tube centrally disposed in the casing.

SUMMARY OF THE INVENTION

The general purpose of the present gaming device, described subsequently in greater detail, is to provide a gaming device which has many novel features that result in a gaming device which is not anticipated, rendered obvious, suggested, or even implied by prior art, either alone or in combination thereof.

To accomplish this, the present gaming device includes a housing and a lockable access door disposed on the housing to provide access for repairs and to prevent tampering. A transparent casing, disposed on a top side of the housing, includes a continuous outer wall, a lid, and a continuous cavity disposed between the outer wall and the lid. A ball receiving tube, having an upper chamber removably disposed thereon and a cover, is centrally disposed through lid and into the cavity. The upper chamber has a lower side that slidably engages a lower chamber of the ball receiving tube. A ball receptacle is centrally disposed within the upper chamber cover and extends into a portion of the upper chamber. A plurality of holes is disposed in the ball receptacle. At least one key-operated latch is disposed on the lid. In addition, a raised plate is continuously disposed within the casing on a bottom end thereof. Further, an opening centrally disposed within the plate and the bottom end. A vent is disposed on a bottom side of the housing.

The present device also includes a blower assembly. The blower assembly includes a motor, a fan, and a filter. The motor is disposed within the housing and a fan compartment is centrally disposed within the housing to provide air circulation within the housing, through the airflow tube, through the cavity, into the ball receiving tube, and out the holes in the upper chamber ball receptacle. A fan is disposed within the fan compartment. The fan is in operational communication with the motor. A airflow tube is disposed between a top end of the fan compartment and the opening. The airflow tube has a diameter configured to prevent an object contained within the cavity from entering the airflow tube. The filter is disposed proximal to the fan to maintain the motor and fan in working condition. The filter assists in preventing damage from smoke, unclean air, and other environmental hazards often encountered in a casino. The vent permits heat generated by the motor and the fan to escape from the cavity to prevent overheating of the motor and the fan. An on-off switch, which is in operational communication with the motor, is disposed on the housing proximal to the casing. The instant device also includes a plurality of lightweight hollow air-filled bouncing numbered balls which include two sets of numbered balls. Each set of the numbered balls has six numbered balls uniquely numbered from 1 through 6. Activation and alternate deactivation of the on-off switch respectively activates and deactivates the motor. Activation and alternate deactivation of the motor respectively activates and deactivates the fan. Activation of the fan circulates air within the cavity. Upon circulation of air within the cavity, the numbered balls bounce and a pair of the numbered balls randomly enters the ball receiving tube upper chamber. Thus, a user can activate the on-off switch as a substitute for rolling a pair of dice on a craps table during a craps game. The plate provides a surface against which the numbered balls can bounce. The casing is transparent to provide visibility of the numbered balls as the numbered balls bounce and a pair of the numbered balls enter the upper chamber of the ball receiving tube.

The present gaming device further includes a signal receiver disposed within the housing. The signal receiver is in operational communication with the motor. A remote signal transmitter is in wireless operational communication with the signal receiver. The signal transmitter is attached to a first end of a securement member and a second end of the securement member is attached to the housing. Activation and alternate deactivation of the signal transmitter respectively activates and deactivates the signal receiver. Activation and alternate deactivation of the signal receiver respectively activates and deactivates the motor. The remote signal transmitter allows a user to activate the on-off switch, rather than activating the on-off switch directly, as a substitute for rolling a pair of dice on a craps table during a craps game.

A support shelf is disposed within the housing. The support shelf is configured to support the fan in a position suspended within the housing above the housing bottom side. The support shelf increases the life of the motor and the fan over disposition of the motor and the fan on the bottom side of the housing by reducing jarring of the motor and the fan during transport.

In order to store the device under a casino standard craps table, the housing has a height of approximately 36 inches, a width of approximately 17½ inches and a depth of approximately 21½ inches while the casing has a height of approximately 14½ inches. The upper chamber of the ball receiving tube has a height of approximately 4½ inches. A plurality of caster wheels is disposed on the housing bottom side so that the device can be rolled to varying locations and, further, rolled beneath or away from underneath a craps table. While the present device can be a floor version, a table top version is also contemplated for mounting to a craps table. The table top version includes the casing and the numbered balls as well as a blower assembly and an on-off switch.

Thus has been broadly outlined the more important features of the present gaming device so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

Figure 1:
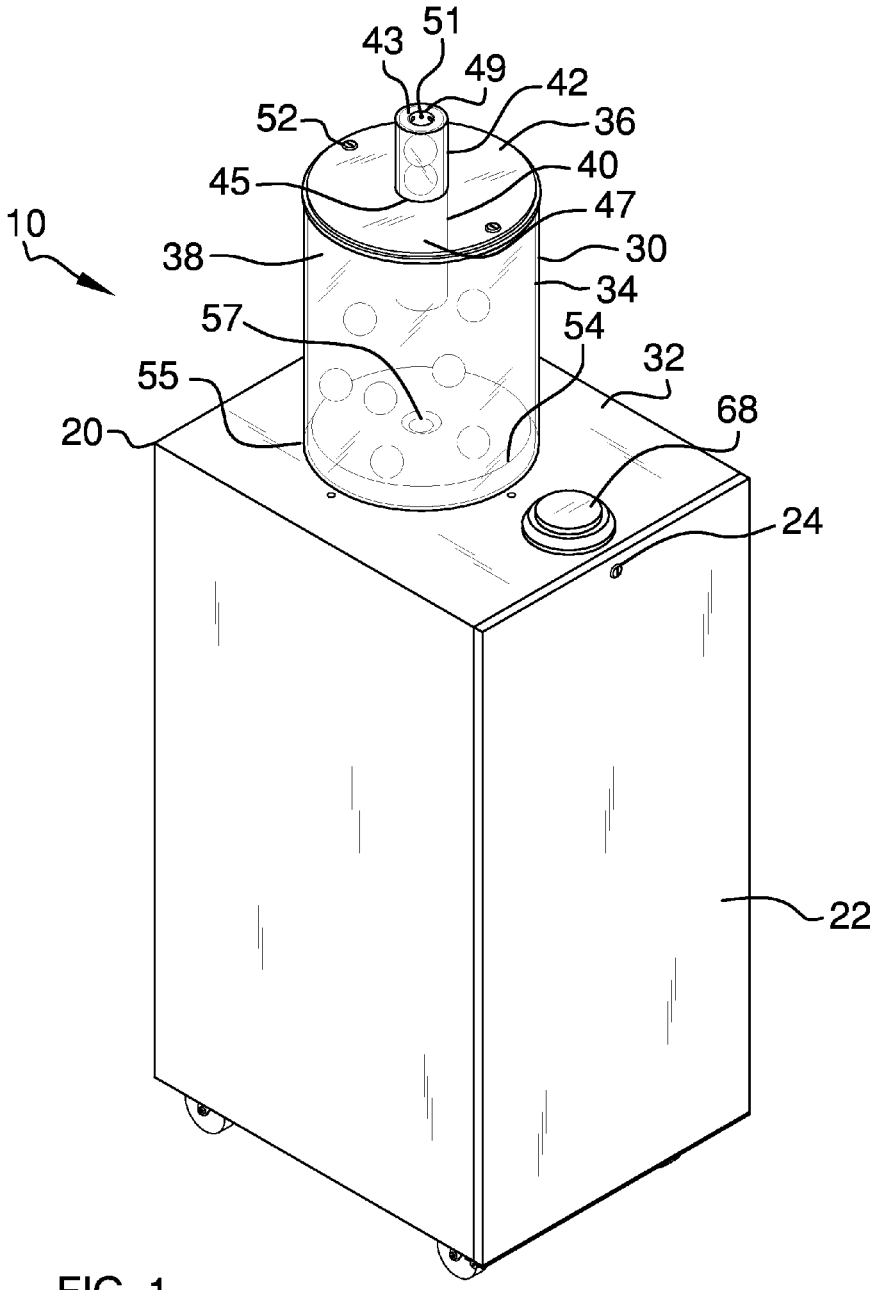
FIG. 1 is an isometric view.
Figure 2:
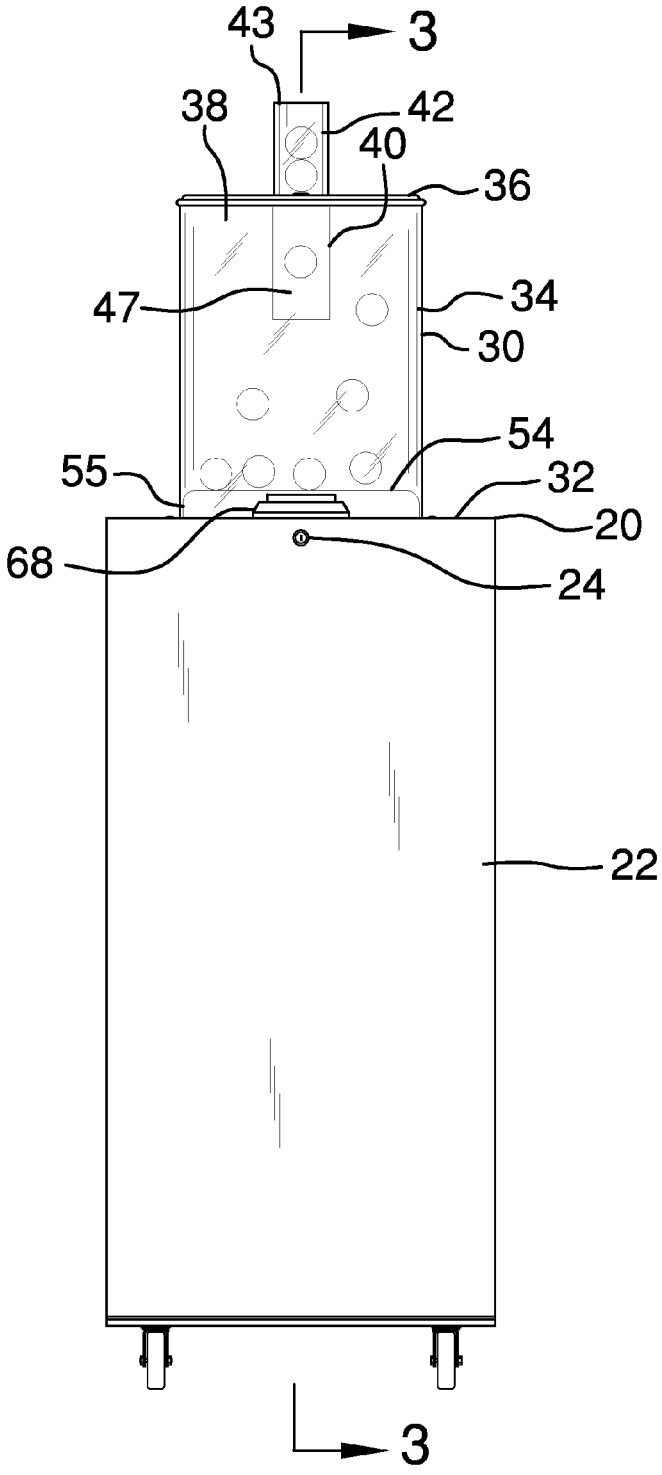
FIG. 2 is a front elevation view.
Figure 3:
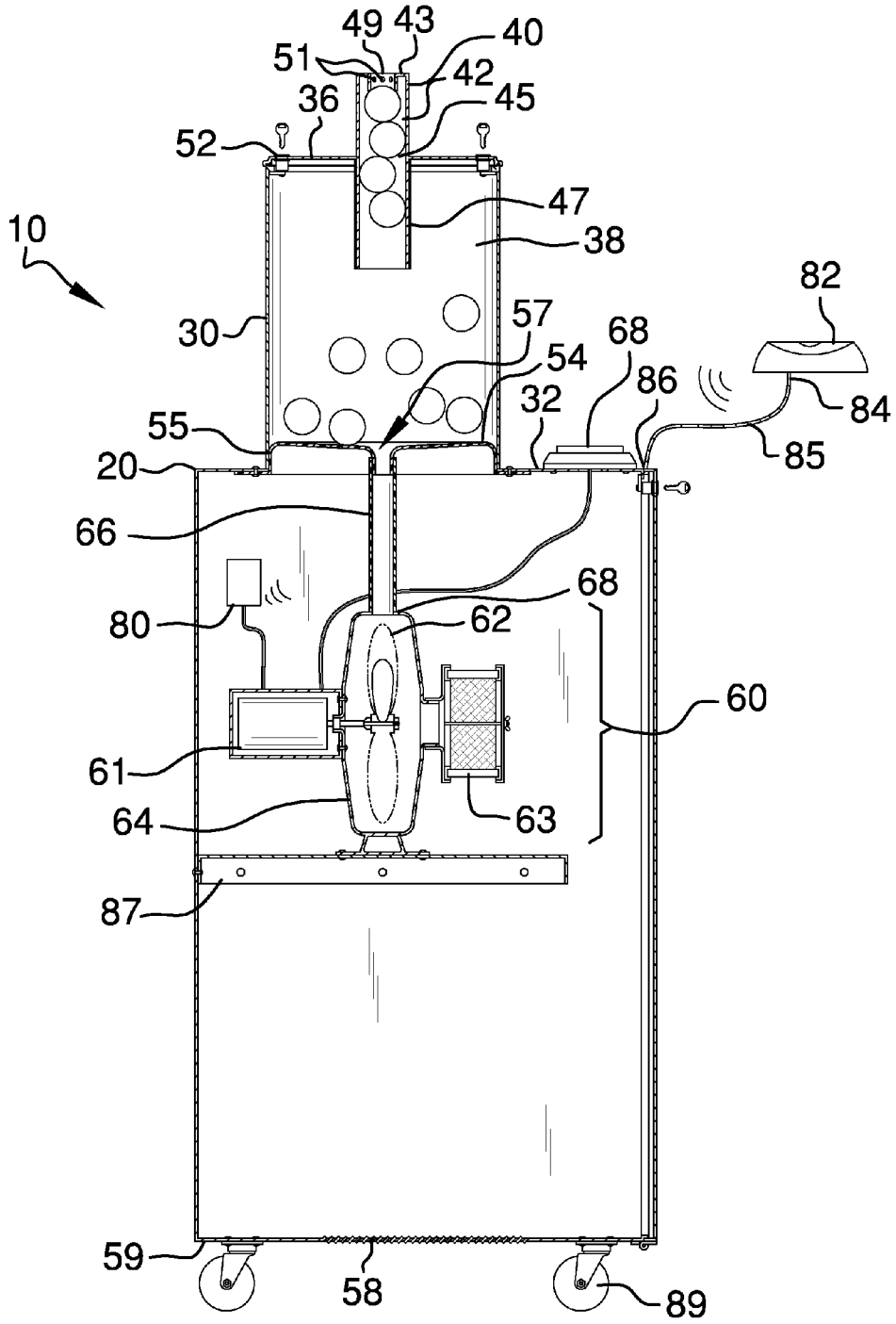
FIG. 3 is a cross-sectional view taken along line 3-3 of FIG. 2.
Figure 4:
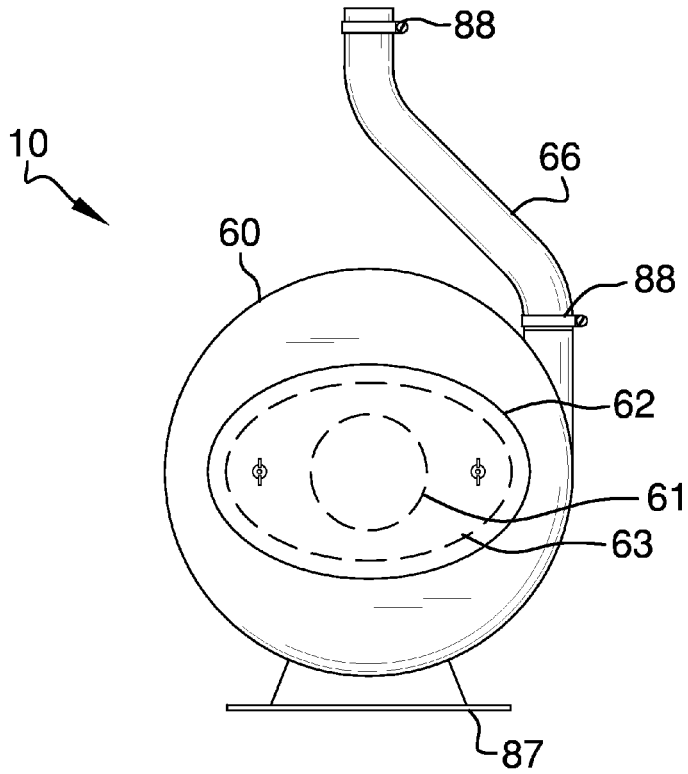
FIG. 4 is a side elevation view of the filter.
Figure 5:
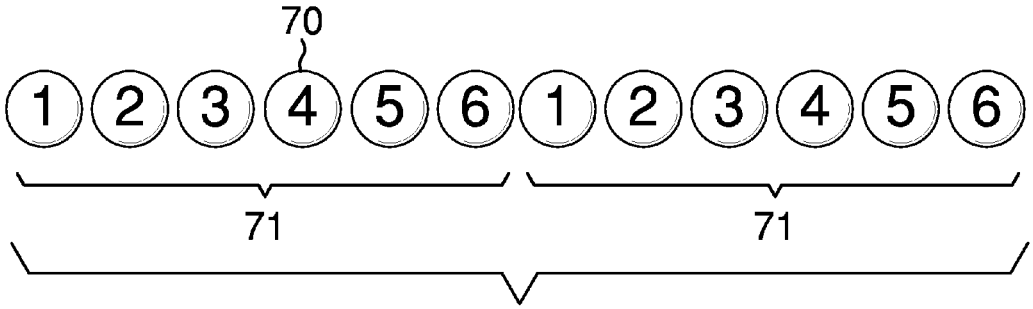
FIG. 5 is a front elevation view of a plurality of numbered balls.

With reference now to the drawings, and in particular FIGS. 1 through 5 thereof, an example of the instant gaming device employing the principles and concepts of the present gaming device and generally designated by the reference number 10 will be described.

Referring to FIGS. 1 through 5 a preferred embodiment of the present gaming device 10 is illustrated. The gaming device 10 is designed to randomly generate at least one pair of numbers in a craps game. The device 20 includes a housing 20 and an access door 22 disposed on the housing 20. A first lock 24 is disposed on the access door 22. A transparent casing 30 is disposed on a top side 32 of the housing 20.

The transparent casing 30 includes a continuous outer wall 34. A lid 36 is disposed on the casing 30. A continuous cavity 38 is disposed between the outer wall 34 and the lid 36. A ball receiving tube 40 is centrally disposed through lid 36 and into the cavity 38. The ball receiving tube 40 has an upper chamber 42 removably disposed thereon. A cover 43 is disposed on the upper chamber 42. The upper chamber 42 has a lower side 45 that slidably engages a lower chamber 47 of the ball receiving tube 40.

A ball receptacle 49 is centrally disposed within the upper chamber 42 cover 43 and extends into a portion of the upper chamber 42. A plurality of holes 51 is disposed in the ball receptacle 49. The holes 51 provide an air outflow port. At least one key-operated latch 52 is disposed on the lid 36. In addition, a raised plate 54 is continuously disposed within the casing 30 on a bottom end 55 thereof. Further, an opening 57 is centrally disposed within the plate 54 and the bottom end 55. A vent 58 is disposed on a bottom side 59 of the housing 20.

The present device also includes a blower assembly 60. The blower assembly 60 includes a motor 61, a fan 62, and a filter 63. The motor 61 is disposed within the housing 20 and a fan compartment 64 that stores the fan 62 is centrally disposed within the housing. The fan 62 is in operational communication with the motor 61 provides air circulation within the housing 20, through the airflow tube 66, through the cavity 38, into the ball receiving tube 40 and out through the holes 51. A airflow tube 66 is disposed between a top end 68 of the fan compartment 64 and the opening 57. The airflow tube 66 has a diameter configured to prevent an object contained within the cavity 38 from entering the airflow tube 66. The filter 63 is disposed proximal to the fan 62 to prevent damage from smoke and unclean air in a casino in which the device 10 is located.

An on-off switch 68, which is in operational communication with the motor 61, is disposed on the housing 20 proximal to the casing 30.

The instant device also includes a plurality of lightweight hollow air-filled bouncing numbered balls 70 which include two sets 71 of numbered balls 70. Each set 71 of the numbered balls 70 has six numbered balls uniquely numbered from 1 through 6.

Activation and alternate deactivation of the on-off switch 68 respectively activates and deactivates the motor 61. Activation and alternate deactivation of the motor 61 respectively activates and deactivates the fan 62. Activation of the fan 62 circulates air within the cavity 38. Upon circulation of air within the cavity 38, the number balls 70 bounce within the cavity 38 and a pair of the numbered balls 70 randomly enters the ball receiving tube 40 upper chamber 42.

The present gaming device 10 further includes a signal receiver 80 disposed within the housing 20. The signal receiver 80 is in operational communication with the motor 61. A remote signal transmitter 82 is in wireless operational communication with the signal receiver 80. The signal transmitter 80 is attached to a first end 84 of a securement member 85 and a second end 86 of the securement member 85 is attached to the housing 20. Activation and alternate deactivation of the signal transmitter 82 respectively activates and deactivates the signal receiver 80. Activation and alternate deactivation of the signal receiver 80 respectively activates and deactivates the motor 61.

A support shelf 87 is disposed within the housing 20. The support shelf 87 is configured to support the fan 62 in a position suspended within the housing 20 above the housing 20 bottom side 59. A hose clamp 88 secures the In order to store the device 10 under a casino standard craps table, the housing 20 has a height of approximately 36 inches, a width of approximately 17½ inches and a depth of approximately 21½ inches while the casing 30 has a height of approximately 14½ inches. The upper chamber 42 of the ball receiving tube 40 has a height of approximately 4½ inches. A plurality of caster wheels 89 is disposed on the housing 20 bottom side 59 so that the device 10 can be rolled to varying locations and, further, rolled beneath or away from underneath a craps table.

What is claimed is:

1. A gaming device configured to randomly generate at least one pair of numbered balls in a craps game, the gaming device comprising:

a housing;

an access door disposed on the housing;

a first lock disposed on the access door;

a transparent casing disposed on a top side of the housing, the transparent casing comprising:

a continuous outer wall;

a lid disposed on the casing;

a continuous cavity disposed between the outer wall and the lid;

a ball receiving tube centrally disposed through lid and into the cavity, the ball receiving tube having an upper chamber removably disposed thereon, the upper chamber configured to receive and secure only a pair of numbered balls simultaneously therein;

a cover disposed atop the upper chamber;

a lower side of the upper chamber, wherein the lower side slidably engages a lower chamber of the ball receiving tub;

a ball receptacle centrally disposed within the upper chamber cover, the ball receptacle extending into a portion of the upper chamber;

a plurality of holes disposed in the ball receptacle;

at least one key-operated latch disposed on the lid;

a raised plate continuously disposed within the casing on a bottom end thereof;

an opening centrally disposed within the plate and the bottom end;

a blower assembly comprising:

a motor disposed within the housing;

a fan compartment centrally disposed within the housing;

a fan disposed within the fan compartment, wherein the fan is in operational communication with the motor;

a filter disposed proximal to the fan;

a airflow tube disposed between a top end of the fan compartment and the opening, wherein the airflow tube has a diameter configured to prevent an object contained within the cavity from entering the airflow tube;

an on-off switch disposed on the housing proximal to the casing, wherein the on-off switch is in operational communication with the motor;

a vent disposed on a bottom side of the housing;

a plurality of lightweight hollow air-filled bouncing numbered balls comprising two sets of numbered balls, each set of the numbered balls having six numbered balls uniquely numbered from 1 through 6;

wherein activation and alternate deactivation of the on-off switch respectively activates and deactivates the motor;

wherein activation and alternate deactivation of the motor respectively activates and deactivates the fan;

wherein activation of the fan circulates air within the cavity; and wherein upon circulation of air within the cavity a pair of the numbered balls randomly enters the ball receiving tube upper chamber.

2. The gaming device of claim 1 further comprising:

a signal receiver disposed within the housing, the signal receiver in operational communication with the motor;

a remote signal transmitter in wireless operational communication with the signal receiver, wherein the signal transmitter is attached to a first end of a securement member and a second end of the securement member is attached to the housing;

wherein activation and alternate deactivation of the signal transmitter respectively activates and deactivates the signal receiver; and wherein activation and alternate deactivation of the signal receiver respectively activates and deactivates the motor.

3. The gaming device of claim 2 further comprising:

a support shelf disposed within the housing, the support shelf configured to support the fan in a position suspended within the housing above the housing bottom side.

4. The gaming device of claim 3 further comprising:

a plurality of caster wheels disposed on the housing bottom side.

5. A gaming device configured to randomly generate at least one pair of numbered balls in a craps game, the gaming device comprising:

a housing;

an access door disposed on the housing;

a first lock disposed on the access door;

a transparent casing disposed on a top side of the housing, the transparent casing comprising:

a continuous outer wall;

a lid disposed on the casing;

a continuous cavity disposed between the outer wall and the lid;

a ball receiving tube centrally disposed through lid and into the cavity, the ball receiving tube having an upper chamber removably disposed thereon, the upper chamber configured to receive and secure only a pair of numbered balls simultaneously therein;

a cover disposed atop the upper chamber;

an lower side of the upper chamber, wherein the lower side slidably engages a lower chamber of the ball receiving tube;

a ball receptacle centrally disposed within the upper chamber cover, the ball receptacle extending into a portion of the upper chamber;

a plurality of holes disposed in the ball receptacle;

at least one key-operated latch disposed on the lid;

a raised plate continuously disposed within the casing on a bottom end thereof;

an opening centrally disposed within the plate and the bottom end;

a motor disposed within the housing;

a fan compartment centrally disposed within the housing;

a fan disposed within the fan compartment, wherein the fan is in operational communication with the motor;

a airflow tube disposed between a top end of the fan compartment and the opening, wherein the airflow tube has a diameter configured to prevent an object contained within the cavity from entering the airflow tube;

a filter disposed proximal to the fan;

an on-off switch disposed on the housing proximal to the casing, wherein the on-off switch is in operational communication with the motor;

a vent disposed on a bottom side of the housing;

a plurality of lightweight hollow air-filled bouncing numbered balls comprising two sets of numbered balls, each set of the numbered balls having six numbered balls uniquely numbered from 1 through 6;

wherein activation and alternate deactivation of the on-off switch respectively activates and deactivates the motor;

wherein activation and alternate deactivation of the motor respectively activates and deactivates the fan;

wherein activation of the fan circulates air within the cavity;

wherein upon circulation of air within the cavity a pair of the numbered balls randomly enters the ball receiving tube upper chamber;

a signal receiver disposed within the housing, the signal receiver in operational communication with the motor;

a remote signal transmitter in wireless operational communication with the signal receiver, wherein the signal transmitter is attached to a first end of a securement member and a second end of the securement member is attached to the housing;

wherein activation and alternate deactivation of the signal transmitter respectively activates and deactivates the signal receiver;

wherein activation and alternate deactivation of the signal receiver respectively activates and deactivates the motor;

a support shelf disposed within the housing, the support shelf configured to support the fan in a position suspended within the housing above the housing bottom side;

a plurality of caster wheels disposed on the housing bottom side;

wherein the housing has a height of approximately 36 inches, a width of approximately 17½ inches and a depth of approximately 21½ inches;

wherein the casing has a height of approximately 14½ inches; and wherein the upper chamber of the ball receiving tube has a height of approximately 4½ inches.

* * * * *